US005590515A

United States Patent [19]

Boden

[11] Patent Number: 5,590,515

[45] Date of Patent: Jan. 7, 1997

[54] SPINNING APPARATUS AND CONTROL ARRANGEMENT THEREFOR

[75] Inventor: Karl Boden, Jülich, Germany

[73] Assignee: Forschungszenlrum Jülich GmbH, Jülich, Germany

[21] Appl. No.: 575,694

[22] Filed: Dec. 19, 1995

Related U.S. Application Data

[63] Continuation-in-part of PCT/DE94/00729 Jun. 24, 1994.

[30] Foreign Application Priority Data

Jun. 30, 1993 [DE] Germany ..... 43 21 757.5
Aug. 26, 1993 [DE] Germany ..... 43 28 710.7

[51] Int. Cl.[6] ..... D01H 1/04; D01H 7/66

[52] U.S. Cl. ..... 57/264; 57/67; 57/68; 57/74; 57/127; 57/352; 57/354

[58] Field of Search ..... 57/67, 74, 75, 57/66, 352, 354, 124, 127, 119, 264

[56] References Cited

U.S. PATENT DOCUMENTS 3,117,409 1/1964 Shino ..... 57/67
3,851,448 12/1974 Sano et al. ..... 57/75
4,592,196 6/1986 Wolf ..... 57/67
4,862,687 9/1989 Marchiori et al. ..... 57/67
4,959,953 10/1990 Krawietz ..... 57/67
5,197,270 3/1993 Stahlecker ..... 57/354

FOREIGN PATENT DOCUMENTS 458154 11/1991 European Pat. Off. ..... 57/74
4103369 9/1991 Germany .

*Primary Examiner*—William Stryjewski
*Attorney, Agent, or Firm*—Klaus J. Bach

[57] ABSTRACT

In a spinning apparatus including a rotatable spindle carrying a package for receiving a yarn from a yarn guide which is arranged in axial alignment with the spindle, a tubular element surrounds the package and the spindle and is floatingly supported by magnetic bearings and a second yarn guide is arranged so to be rotatable within the tubular element and receives the yarn for guiding it onto the package with a winding speed corresponding to the rotational speed difference between the spindle and the tubular element and sensors are arranged adjacent the tubular element for sensing any axial deviation of the tubular element from its desired position which axial deviation is taken as a measure for the yarn tension forces.

13 Claims, 9 Drawing Sheets

SPINNING APPARATUS AND CONTROL ARRANGEMENT THEREFOR

This is a continuation-in-part Application of International Application PCT/DE94/00729 filed Jun. 24, 1994 and claiming priority of German Applications P 43 21 757.5 of Jun. 30, 1993 and P 43 28 710.7 of Jun. 26, 1993.

BACKGROUND OF THE INVENTION

The invention relates to a spinning apparatus with a take up package for the yarn which take up package is mounted on a rotatable spindle. The spinning apparatus includes further a yarn guide arranged concentrically with the spindle and receiving the yarn, a rotation-symmetrical element which concentrically surrounds the spindle and is magnetically supported so as to be freely floating, and a second yarn guide which rotates with the element and which is so mounted to the rotation-symmetrical element that it engages the yarn which, during rotation abuts the inner wall of the element from within the rotation-symmetrical element and leads it to the spindle and, during the relative movement between the spindle and the element, winds the yarn onto the spindle. The invention further relates to a control and a regulating arrangement for such a spinning device.

A spinning device as described above is known for example from German application DE OS 41 03 369.

In a particular embodiment of this application, the yarn is guided within the spinning or yarn ring, such that the yarn ring also serves as a balloon limiter. In this embodiment, there is provided, in the area of the lower front end, an ear-like yarn guide which may be an inwardly projecting component. There is further another embodiment wherein the spinning or yarn ring extends over a greater axial length of the spindle and is floatingly supported by two axially spaced magnetic bearings to provide stabilization wherein the two magnetic bearings are radially active magnet bearings.

This known arrangement solves some of the problems occurring generally with ring spinning. The problems are usually the result of friction between the ring and the traveller usually used, of the stress on the yarn by tension peaks and of stress forces of the yarn in the balloon (C. M. Bringer: "Rotating Rings in Ring Spinning Processes"/ Fortschrittsberichte der VDI Zeitschriften, series 3 No. 93; Düsseldorf: VDI Publishing House, 1984). By use of the magnetically supported ring (corresponding to the rotation-symmetrical element) as a yarn guide the friction between the ring and the traveller is avoided. An arrangement which utilizes a doubly supported spinning or yarn ring prevents cogging of the ring but its design is complicated and expensive.

SUMMARY OF THE INVENTION

It is the object of the invention to provide a spinning apparatus which is relatively inexpensive to manufacture and energy efficient in operation and which provides for an improved yarn or yarn quality. It is further an object of the invention to provide a control arrangement and a regulating arrangement which permits optimum utilization of the advantages obtainable by the spinning apparatus according to the invention.

In a spinning apparatus including a rotatable spindle carrying a package for receiving a yarn from a yarn guide which is arranged in axial alignment with the spindle, a tubular element surrounds the package and the spindle and is floatingly supported by magnetic bearings and a second yarn guide is arranged so as to be rotatable within the tubular element and receives the yarn for guiding it onto the package with a winding speed corresponding to the rotational speed difference between the spindle and the tubular element and sensors are arranged adjacent the tubular element for sensing any axial deviation of the tubular element from its desired position which axial deviation is taken as a measure for the yarn tension forces.

The radially active, axially passive magnetic bearing which surrounds the lower portion of the tubular rotation-symmetrical element may be, for example, a magnetic bearing which, in axial direction, floatingly supports the element, which consists at least partially of a ferromagnetic material, by way of an axially magnetized permanent magnet which surrounds the element and stabilizes it in radial direction by electromagnetic means arranged annularly around the element. The electromagnetic means can be energized by way of an electronic control arrangement connected to sensors which sense any radial deviation of the tubular rotation-symmetrical element. Such a magnetic bearing is described in DE PS 24 20 825.

The radially stable, axially unstable magnetic bearing on the other hand may consist of two annular permanent magnets which are arranged concentrically with the axis of the spindle and of which one is mounted on the collar of the element so as to be rotatable therewith and the other is firmly mounted on the outside so as to be disposed opposite the one annular magnet. Consequently, the radially symmetrical element is supported in the axially unstable magnetic bearing in an axially spring-like fashion. Axial stability is achieved by cooperation of the two magnetic bearings.

The sensors for determining the axial deviation of the axially symmetrical element are adapted, in connection with the associated electronic device, to determine the tension forces effective on the yarn.

The collar at the upper end of the tubular element serves as mounting structure for the upper magnetic bearing but also results in a reduced air circulation within the element which reduces losses and saves energy.

The energy savings effect is increased in a preferred embodiment of the spinning device according to the invention wherein at the end receiving the incoming yarn, the tubular element is closed by the collar except for a small round opening in the center of the collar which forms the yarn guide arranged centrally with regard to the spindle. In this funnel-like arrangement, the centrally arranged yarn guide is formed by the central opening and it consequently rotates with the element. This essentially eliminates the friction between the yarn and the yarn guide which is normally present with firmly mounted yarn guides and which has not only a negative influence on the winding process, but also on the spinning process as it generates an objectionable moment on the yarn. This is eliminated with the arrangement according to the invention. Only the friction resulting from the axial movement of the yarn remains.

The rotation of the yarn which results from the winding is now transferred to the spinning zone in proper fashion. This results in a high yarn strength in the spinning zone with a relatively low yarn tension level, greater yarn elasticity, lower fuzziness of the yarn and, finally, also in a reduced number of yarn ruptures.

In an advantageous embodiment, the tubular element is slightly conical with a diameter decreasing in upward axial direction. The arrangement provides for the tubular element to surround the spindle with the smallest possible clearance.

This results in a relatively small diameter tubular element which has a relatively small moment of inertia and, therefore is relatively energy efficient.

A very advantageous arrangement the spindle is moved into the tubular element to achieve the relative axial movement between the tubular element and the spindle.

Normally, the winding procedure begins at the lower end of the package and the element and package are moved in such a manner that the winding of the yarn progresses in a upward direction. The growing package is generally outside the tubular element which causes a substantial increase of the aerodynamic losses with increasing length and diameter of the package.

With the spinning arrangement according to the preferred embodiment of the present invention however, the package is generated and its diameter and axial length increases during winding within the sleeve-like element. Since the element and the package rotate in the same sense and essentially at the same speed the aerodynamic losses of the package are very small as compared to the movement of package and element during winding in prior art arrangements.

Since the yarn is guided on the inside of the tubular element and the element serves as a balloon limiter, the overall friction is reduced as the air resistance on the outside of the element is smaller than the friction generated by a yarn balloon as normally formed during winding. But in a further embodiment of the spinning device according to the invention, wherein the axially symmetrical element is surrounded by a stationary protective tube, the air resistance losses are even further reduced.

Such a protective tube preferably carries, at the front end where the yarn enters, an inwardly projecting collar on which the radially stable, axially instable magnetic bearing is mounted. It is further advantageous if the air gap between the radially symmetrical element and the protective tube is not larger than 2–10 mm.

A further reduction of the air resistance is achieved with an embodiment wherein the protective tube includes a connecting flange for a suction arrangement which permits the generation of a vacuum in the gap between the element and the protective tube. The vacuum in the gap further reduces air resistance losses.

Since the yarn abuts during spinning, the inside of the radially symmetrical element and, at the same time, also the inner edge of the central opening serving as a yarn guide, an arrangement has been found to be particularly advantageous wherein a small tube is arranged on the inside wall of the element which extends between the yarn guides and which receives the yarn within the element. This arrangement permits the yarn end to be suctioned in through the small tube to facilitate the start-up of the spinning process. It is understood, of course, that the sleeve-like element with the additional small tube must be balanced.

While the embodiment of the tubular element with the small inner tube facilitates threading of the yarn, another embodiment attends to the spinning start-up procedure itself: If the yarn guide which guides the yarn to the package is firmly mounted to the element and if only the element or only the package is provided with a drive, then the respective other part is carried along during spinning start-up by the yarn and, consequently, is also rotated. This generates an additional tension force in the yarn during the spinning start-up phase which is not desirable.

To avoid such yarn stress, in another embodiment of the invention the yarn guide which is mounted on the sleeve-like element and guides the yarn to the package ms designed as a rotor rotating along the inner circumference of the element. This arrangement is particularly suitable for measuring yarn tensional forces by means of sensors and the associated electronic devices.

A relative motion between the rotor and the radially symmetrical element occurs in this arrangement only during the spinning start-up period. Because of its small inertia the rotor will rapidly follow the rotation of the driven part, but will not rotate relative to the sleeve-like element when both parts have the same rotational speed. Consequently, after the spinning start-up period, the situation is the same as it is with a guide which is firmly mounted on the tubular element so that, during spinning operation, there is no operational difference between an arrangement with a rotatably supported yarn guide and a firmly mounted yarn guide.

The axial length of the sleeve-like element makes it easily possible to provide it with an electric motor drive. Its sole use for driving the sleeve-like element, without additionally driving the spindle, is particularly advantageous in as far as the spindle, because of its smaller circumference and its smaller weight has a lower moment of inertia than the tubular element so that the tension forces on the yarn during the spinning startup period is smaller than it is if only the spindle is driven.

The knowledge of the dynamics of the yarn tension forces obtained from the sensors during operation of the spinning device facilitates minimizing of the yarn tension particularly when, in addition to the spindle drive, an electric motor drive for the tubular element is provided.

By means of a control arrangement which includes technical means for executing a program, which takes into consideration the changes of the yarn tension forces normally occurring during an operational cycle, correspondingly changing drive moments for the sleeve-like element and the spindle can be obtained.

The control program includes the knowledge obtained by way of the sensors concerning the yarn tension forces, which forces are different during the spinning start-up period and during the spinning period (here, for example as a result of the changing inertia of the package) and which can be minimized by appropriate adjustment of the drive torques for the spindle and/or the tubular element.

The regulating arrangement and the control arrangement are preferably used in connection with a spinning apparatus wherein the spindle as well as the radially symmetrical element each has an electric drive motor. The regulating arrangement is characterized by electronics for the stabilization of the yarn tension forces. It utilizes the measurement signals of the sensors for determining the yarn tension forces as guide values and accordingly changes the respective drive torques for the spindle and/or the sleeve-like element.

The invention will become more readily apparent from the following description of same preferred embodiments which are schematically shown in the accompanying drawings.

DESCRIPTION OF A PREFERRED EMBODIMENT

Figure 1:
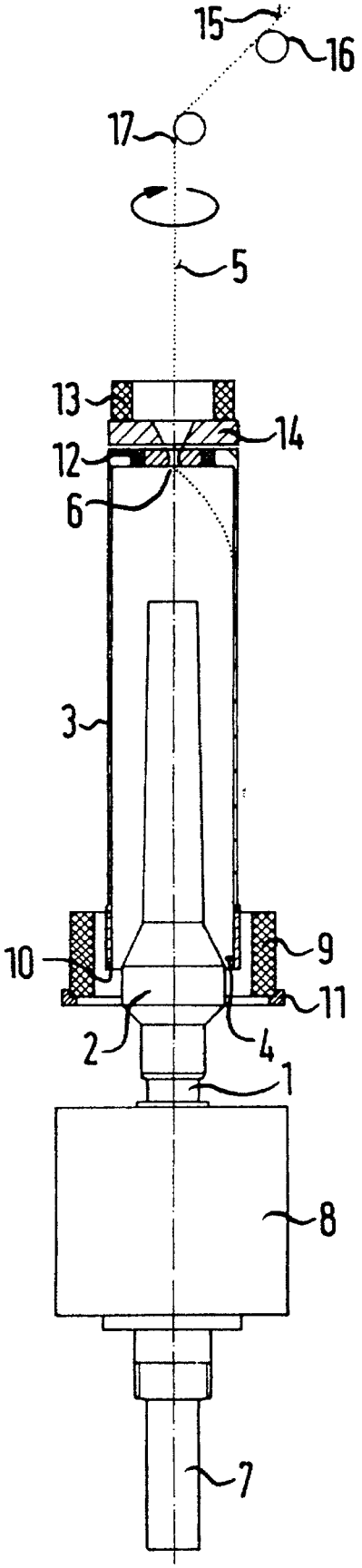
FIG. 1 shows a spinning apparatus with a magnetically supported tubular element and a central yarn guide arranged in the center which rotates with the element.

As shown in FIG. 1, the spinning apparatus includes a spindle 1 on which a package 2 is mounted which is surrounded concentrically by the tubular element 3. At the lower open front end of the tubular element 3, a yarn guide 4 is mounted which guides the yarn 5 to the package 2. This yarn guide 4 can be a guide lug in the form of a hook or it may be in the form of an eyelet. The upper front end of the tubular element 3 is closed except for a central opening 6 which forms a central yarn guide.

The spindle 1 is supported in a bottom bearing 7 which is arranged concentrically with the center axis of the apparatus and is provided with an electric motor drive 8.

The tubular axially symmetric element 3 has no drive and is magnetically supported so as to be freely floating: An axially instable magnetic bearing 9 consisting of electromagnetic means arranged annularly around the element is disposed at the bottom of the tubular element. The electromagnetic means can be energized by means of an electronic regulating device (not shown in the drawing) which has sensors associated therewith which sense the radial deviation of the tubular element 3. To facilitate such measurements, the tubular element has a bottom portion 10 consisting of a ferromagnetic material. The stationary bearing portion is mounted on a support ring 11. The magnetic bearing corresponds to the bearing described in DE patent 24 20 825.

The bottom bearing 7 and the support ring 11 (and together therewith all the parts firmly connected to the support ring 11) are movable in a vertical direction.

The upper magnetic bearing consists of a concentric arrangement of an annular permanent magnet 12 which is mounted to the collar of the tubular element 3, a stationary permanent magnet 13 which is also annular in shape and a dampening element 14 consisting of a non-ferromagnetic material of good electric conductivity which dampens radial movements of the end of the tubular element in accordance with the principle of eddy current dampening. The dampening element 14 is arranged in the air gap between the magnets 12 and 13 which are magnetized preferably in axial direction and is firmly connected to the stationary permanent magnet 13. Both, the permanent magnet 13 and the dampening element 14, are connected to the lower magnetic bearing 9 or the support ring 11 by means of a mechanical connection which is not shown in the drawings.

For the spinning of yarn, the so-called roving 15 which is the starting material for the spinning process, is transported from the feed roller 16 to the spinning zone 17 with constant delivery speed. In preceding process steps, the spinning material (such as cotton) has been cleaned and has been pretreated so as to form a fiber band of constant cross-section and preferably parallel fibers, the so-called roving. In the spinning zone 17, the torque that is the rotation transferred from the rotating tubular element 3 to the yarn (as indicated by an arrow) provides for the desired twisting of the fibers so as to form a firm yarn or yarn 5. This yarn is guided to the axis of rotation of the tubular element by the yarn guide 6 which rotates with the tubular element. Within the tubular element 3, the yarn moves toward the yarn guide 4 which directs the yarn from the circular path around the center axis tangentially onto the package 2 onto which the yarn is wound. On average, the winding speed corresponds to the delivery speed of the yarn. As usual, the spindle is moved during the winding of the yarn axially out of the radially symmetric element.

The tubular element 3 is driven by the yarn forces which are transmitted from the yarn section extending between the package 2 and the yarn guide 4 to the tubular element 3. The rotational speed of the tubular element 3 adjusts itself automatically relative to the speed of the package and, because of the yarn movement, is smaller than the speed of the package or the spindle. The rotational speed difference increases with increasing delivery speed and becomes smaller with growing package diameter.

The yarn is deposited on the package in layers which is achieved by controlled axial relative movement between the package and the tubular element. This movement can be achieved either by axial movement of the bottom bearing 7 if the tubular element remains axially stationary or by axial movement of the support ring 11 if the bottom bearing is axially stationary. It is also possible to utilize both, that is, to superimpose the two movements. The first mentioned variation is preferred because, in that case, the yarn length between the rotating yarn guide and the stationary feed roller remains unchanged. With the two other variations, this yarn length is changing periodically which may result in periodic quality changes of the yarn.

Figure 2:
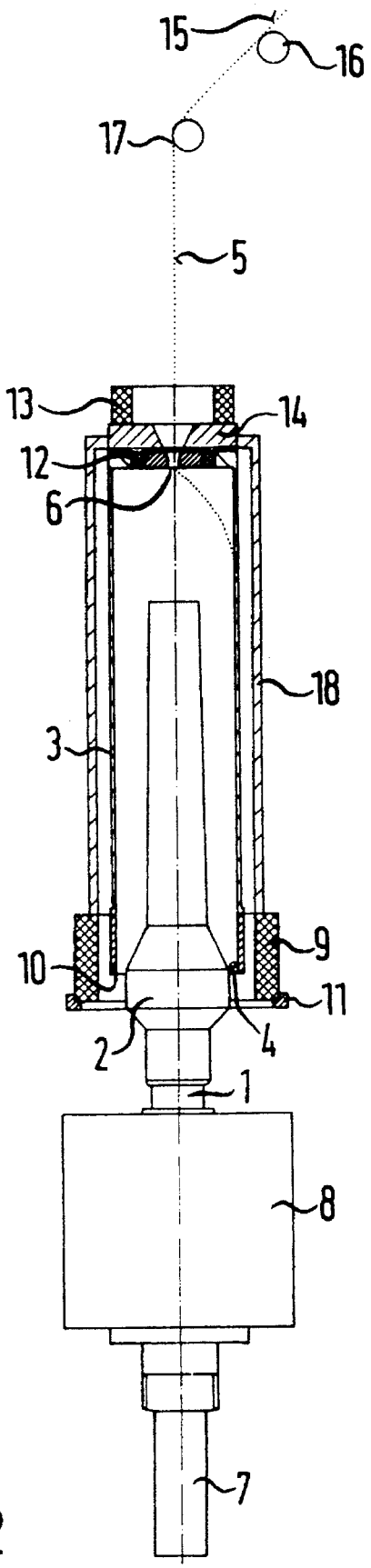
FIG. 2 shows the spinning apparatus of FIG. 1 with a protective tube.

FIG. 2 shows an embodiment of the spinning apparatus wherein a protective tube 18 is disposed around the tubular tube 3.

The protective tube 18 is a closed housing surrounding the tubular element 3. In addition to its protective function, it reduces the noise level and the air resistance on the rotating tubular element 3. In addition, it can be utilized for mounting emergency support bearings for the tubular element 3 in a manner not shown in the drawings.

Figure 3:
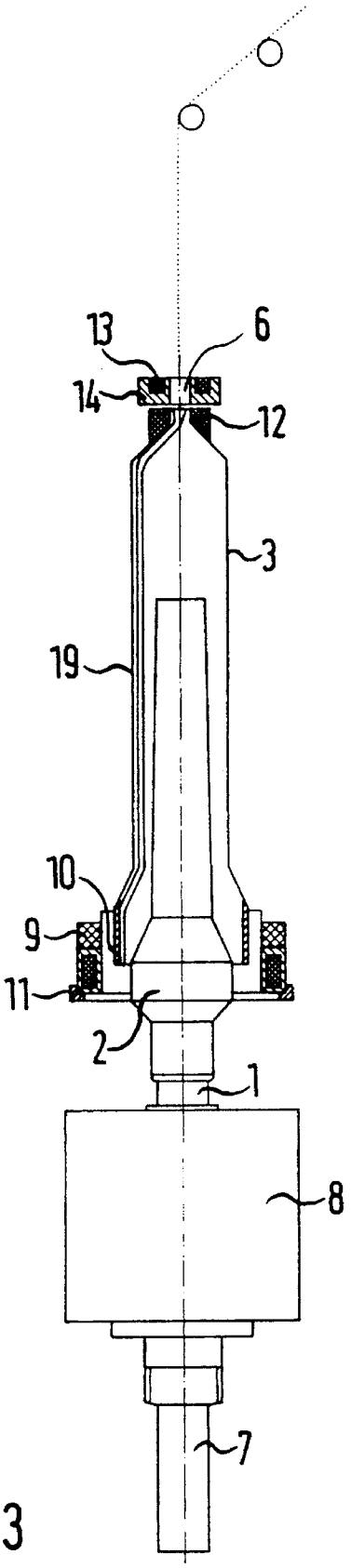
FIG. 3 shows a sleeve-like element provided with an inner small tube and being magnetically supported.

In the embodiment as shown in FIG. 3, a small tube 19 extends along the inner wall of the tubular element 3 which receives the yarn from the central yarn guide 6 and which corresponds to the yarn guide 4 of FIGS. 1 and 2. It guides the yarn to the package 2 and directs it tangentially onto the package 2. Like in the arrangement of FIG. 1, the spindle 1 is driven by an electric motor 8 wherein the yarn guided in the tube 19 moves along the tubular element 3 to provide for its rotation.

This arrangement permits the end of the yarn to be sucked through the small pipe 19 thereby facilitating the start-up procedure for the spinning process.

The collar at the upper end of the tubular element 3 extends upwardly and, at its upper end, forms the central guide opening 6 for receiving the yarn. The design of the upper magnetic bearing corresponds to that shown and described in connection with FIGS. 1 and 2.

Figure 4:
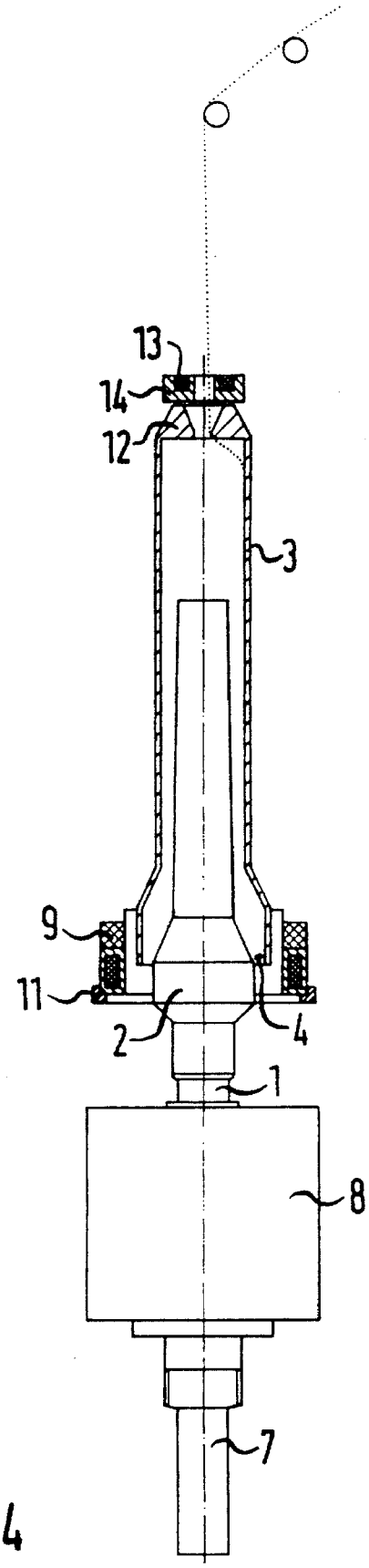
FIG. 4 shows a spinning apparatus with a spindle adapted in size to the tubular element which consists of steel.

FIG. 4 shows an embodiment of the spinning apparatus wherein the tubular element 3 has a diameter close to the diameter of the package 2. In addition, the tubular element 3 consists of steel so that no separate permanent magnet is needed at the upper end of the element 3.

Figure 5:
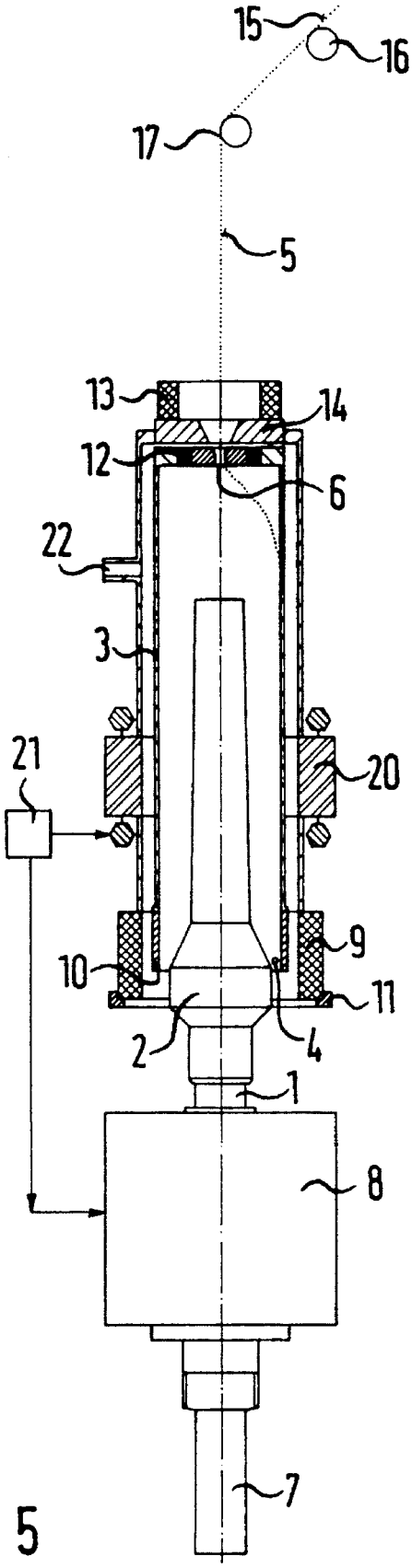
FIG. 5 shows a spinning apparatus like the one shown in FIG. 2 which is provided however with a protective tube and an additional electric motor drive for the sleeve-like element.

The embodiment of the spinning apparatus as shown in FIG. 5 is based on the arrangement as shown in FIG. 2. In addition, it includes an electromagnetic drive for the tubular element 3 which for that reason consists of a ferromagnetic material. The tubular element 3 is also the rotor for an electromagnetic armature 20. Both the drive motor 8 and the electromagnetic drive 20 are energized by a common generator 21. The ferromagnetic tubular element 3 serves also as the rotor for the electromagnetic stator of the drive 20.

Such a magnetic bearing arrangement is described in "K. Boden:" Wide-Gap, Electro -Permanent Magnetic Bearing System with Radial Transmission of Radial and Axial Forces published in "Magnetic Bearings", Proc. of the First International Symp. ETH Zürich, 6.–8. June 1988, Ed. G. Schweitzer, pp. 41–52, Springer Publishing House, Berlin-Heidelberg 1989.

One of the motors is a synchronous drive unit, the other is an asynchronous drive unit so that the speed difference between the package and the tubular element as needed for the winding of the yarn can be easily controlled.

It is, however, also possible to eliminate the drive motor for the spindle 1. For performing the spinning process a drive for the tubular element 3 which represents the rotor for the drive armature 20 and which may be so designed as to operate like a hysteresis with a synchronous start, is actually sufficient. The sleeve-like element 3 then rotates at constant speed. The yarn is subjected to a correspondingly uniform twisting. The package 2 is carried along by the yarn but rotates at lower speed then the tubular element 3. In this arrangement, the inertia forces effective during start-up are relatively small because of the relatively small mass inertia of the spindle and the empty package.

In the embodiment as shown in FIG. 5, the protective tube 18 is provided with a flange 22 for the connection of a vacuum pump. With this arrangement, the air pressure in the annular gap between the radially symmetrical element 3 and the protective tube 18 can be reduced whereby also the air resistance losses can be reduced.

Figure 6:
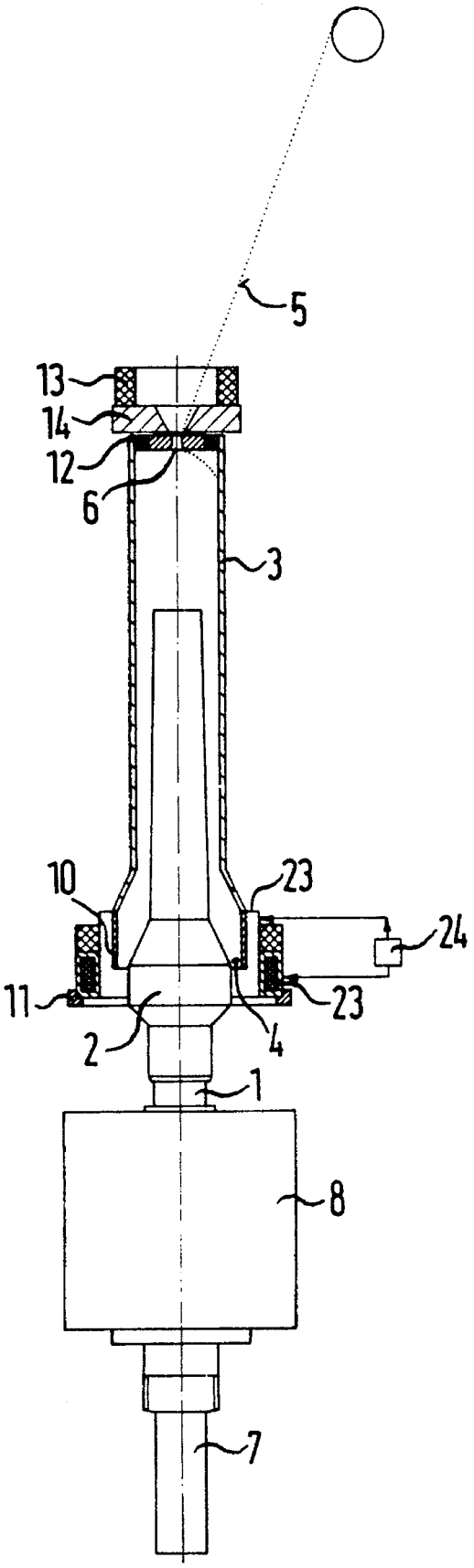
FIG. 6 shows a spinning apparatus with a measuring arrangement for determining the yarn tensioning forces (consisting of sensors and associated electronic processor)

FIG. 6 shows a spinning apparatus with a measuring arrangement for determining the yarn tension forces. This measuring arrangement comprises the sensors 23 for determining the axial deviation of the tubular element 3 from its predetermined position and an associated electronic arrangement 24. The sensors 23 are mounted adjacent an edge of the bottom portion 10 of the tubular element 3 which consists of a ferromagnetic material.

In the present case, the electronic arrangement 24 is part of the electronic control for the magnetic bearing which also utilizes the signals of the sensors 23. The bearing sensor system consequently has a double function in this case.

Figure 7:
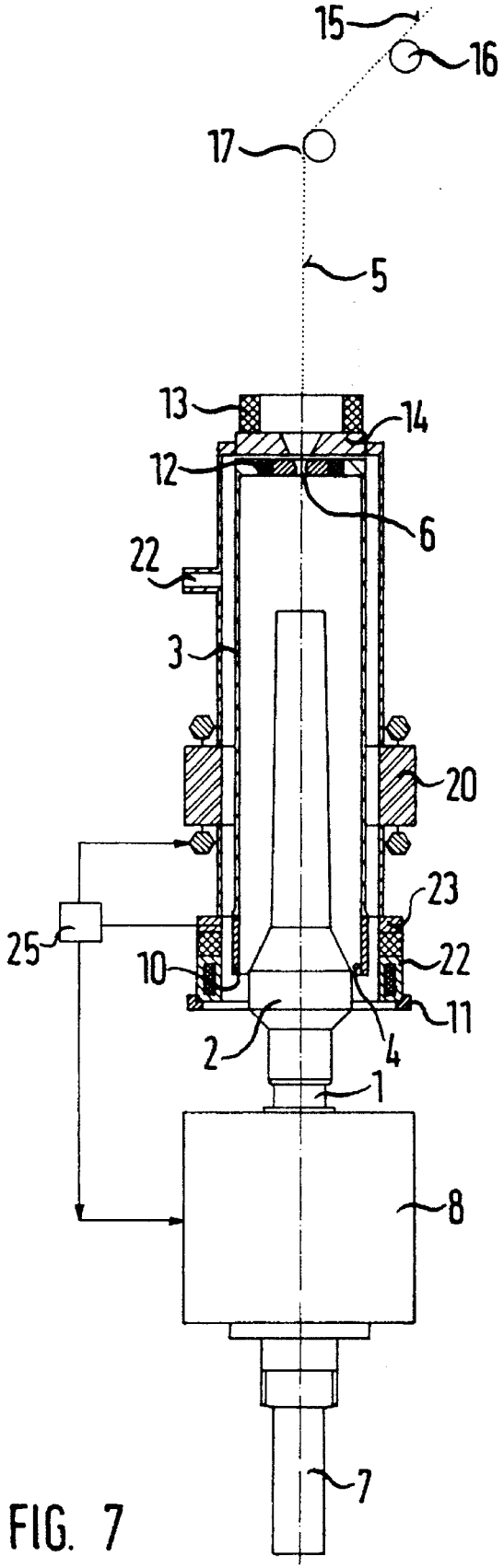
FIG. 7 shows a spinning apparatus according to FIG. 1 with an electric motor drive for the tubular element and the spindle and also with a protective tube and with a regulating arrangement.

FIG. 7 shows an embodiment of the spinning apparatus according to FIG. 5, which however additionally includes the measuring arrangement according to FIG. 6. The signals provided by the sensors 23 are utilized in an electronic unit 25, which is part of the electronic measuring arrangement and which also is a control unit, as guide values for the control of the yarn tension. The yarn tension is controlled by changing the drive torques of the drives 8 and/or 20 and consequently of the spindle and the tubular element 3.

Figure 8:
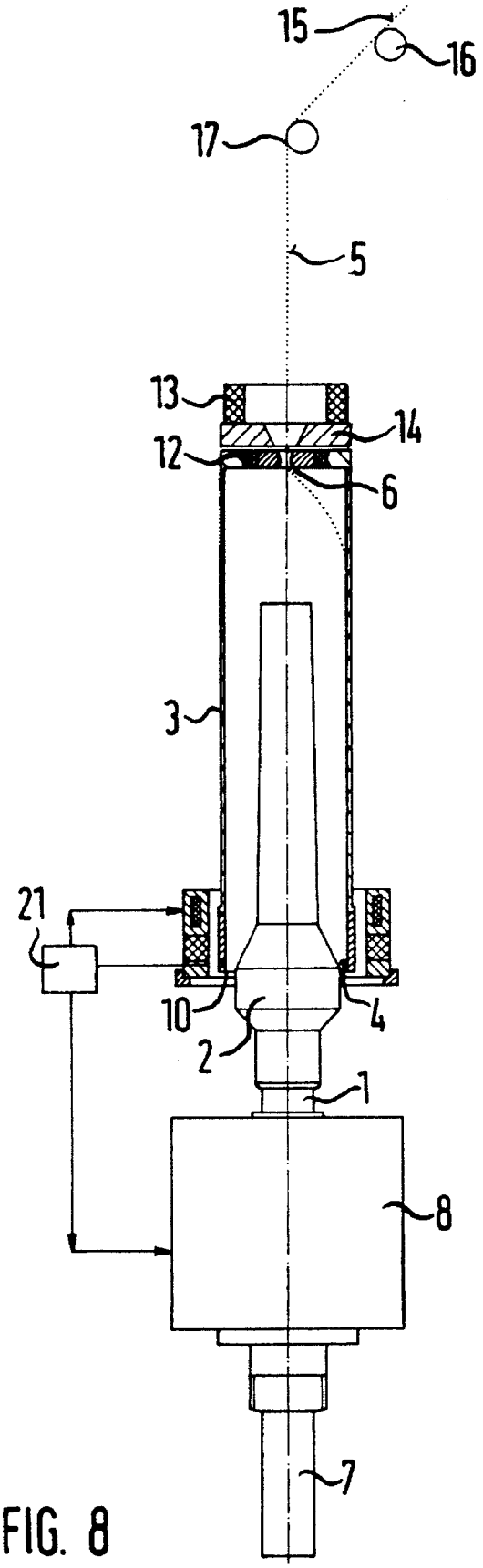
FIG. 8 shows a spinning apparatus according to FIG. 1 with a additional electric motor drive for the tubular element by means of an electromagnetic system for the radial stabilizing arrangement of a radially active magnetic bearing.

FIG. 8 shows an embodiment of the spinning apparatus which is different from that shown in FIG. 5 in that there is no protective tube 8 and, instead of the electronic drive 20, the magnetic bearing system also serves as a drive.

Figure 9:
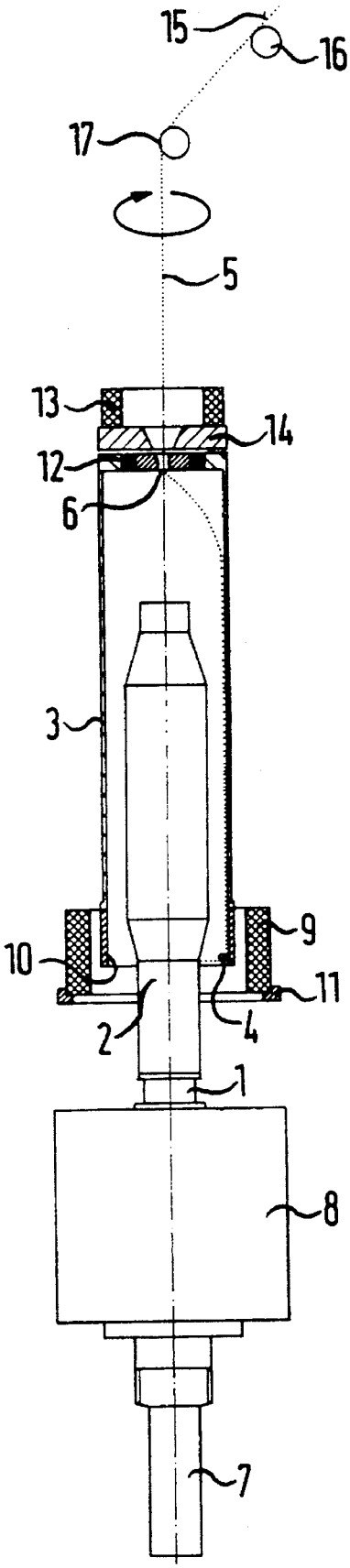
FIG. 9 shows a spinning apparatus according to FIG. 1 wherein relative axial movement between the tubular element and the spindle occurs in such a way that, during winding of the yarn, the spindle is moved axially into the element.

FIG. 9 shows an embodiment of the spinning apparatus which is different from that shown in FIG. 1 in that a different relative movement between the tubular element 3 and the spindle 1 is provided for during the winding procedure. The yarn is wound onto the spindle beginning at its upper end and, in the process, the spindle is moved axially into the tubular element 3.

What is claimed is:

1. A spinning apparatus comprising: a rotatable spindle, a package mounted on said spindle for receiving a yarn, a first yarn guide arranged coaxially with said package for receiving said yarn, a rotatable radially symmetrical tubular element concentrically surrounding said package, said tubular element being supported at its end surrounding said package by an axially passive radially active magnetic bearing which surrounds said tubular element and, at its opposite end by a radially stable axially instable magnetic bearing, a second yarn guide arranged on the inside of said tubular element so as to be rotatable therewith, said second yarn guide receiving the yarn which, during rotation of said tubular element, abuts its inner surface and guiding it to said package for winding it onto said package with a winding speed corresponding to the speed difference between said spindle and said tubular element, sensors disposed adjacent said tubular element for sensing any axial deviation of said tubular element from its predetermined position, and an electronic arrangement associated with said sensors and receiving therefrom signals corresponding to said axial deviations, said electronic arrangement to amplify said signals to represent tensional forces effective in the yarn and utilize them to control the spinning apparatus.

2. A spinning apparatus according to claim 1, wherein said yarn receiving end of said tubular element is closed except for a round central opening arranged coaxially with said package and forming a yarn guide.

3. A spinning apparatus according to claim 1, wherein said tubular element has a conical shape with a reduced diameter at its top, yarn-receiving end.

4. A spinning apparatus according to claim 1, wherein said spindle and said tubular element are axially movable relative to one another and said spindle is axially moved into said tubular element when said yarn is wound onto said package.

5. A spinning apparatus according to claim 1, wherein said tubular element is surrounded by a stationary protective tube.

6. A spinning apparatus according to claim 5, wherein said protective tube has, at its front end directed toward said incoming yarn, an inwardly projecting collar on which said radially stable, axially instable, magnetic bearing is mounted.

7. A spinning apparatus according to claim 5, wherein, between said tubular element and said protective tube, there is an air gap with a width of 2–10 mm.

8. A spinning apparatus according to claim 5, wherein said protective tube is provided with a flange for connecting thereto a vacuum pump.

9. A spinning apparatus according claim 1, wherein a small tube extends along the inner wall of said tubular element for receiving and guiding said yarn within said tubular element.

10. A spinning apparatus according to claim 1, wherein said yarn guide arranged in said tubular element so as to guide said yarn to said package is rotatably supported so as to be movable along the inner surface of said tubular element.

11. A spinning apparatus according to claim 1, wherein an electric drive motor is provided for driving said tubular element.

12. A spinning apparatus having a rotatable spindle, an electric drive operatively connected to said spindle for driving said spindle, said spindle carrying a package for receiving a yarn, a tubular element surrounding said package and being floatingly supported by a magnetic bearing, said tubular element having a yarn guide for guiding said yarn onto said package, and another electric drive for rotating said tubular element with a rotational speed which is different from that of said spindle, means for determining tension forces effective in said yarn, while said yarn is wound onto said package, from the axial deviation of said tubular element from its desired position, and means for controlling said electric drives so as to generate drive torques providing for predetermined yarn tension forces.

13. A spinning apparatus having a rotatable spindle, an electric drive operatively connected to said spindle for driving said spindle, said spindle carrying a package for receiving a yarn, a tubular element surrounding said package and being floatingly supported by a magnetic bearing structure, said tubular element having a yarn guide for guiding said yarn onto said package and another electric drive for rotating said tubular element with a rotational speed which is different from that of said spindle, sensors for determining tension forces effective in said yarn while said yarn is wound onto said package, said sensors providing a guide values, and control means receiving said guide values from said sensors for controlling said electric drives so as to provide drive torques which provide for desired yarn tension forces.

* * * * *